US007542548B2

(12) United States Patent
Matsuo et al.

(10) Patent No.: US 7,542,548 B2
(45) Date of Patent: Jun. 2, 2009

(54) X-RAY OPTICAL SYSTEM

(75) Inventors: Ryuji Matsuo, Kunitachi (JP); Akira Echizenya, Fussa (JP); Go Fujinawa, Hamura (JP)

(73) Assignee: Rigaku Corp., Akishima-shi (JP)

( * ) Notice: Subject to any disclaimer, the term of this patent is extended or adjusted under 35 U.S.C. 154(b) by 0 days.

(21) Appl. No.: 11/973,825

(22) Filed: Oct. 10, 2007

(65) Prior Publication Data

US 2008/0084967 A1 Apr. 10, 2008

(30) Foreign Application Priority Data

Oct. 10, 2006 (JP) ..... 2006-276135

(51) Int. Cl.
*G21K 1/06* (2006.01)

(52) U.S. Cl. ..... 378/84; 378/44; 378/70

(58) Field of Classification Search ..... 378/43–50, 378/70–90, 147, 148, 156
See application file for complete search history.

(56) References Cited

U.S. PATENT DOCUMENTS

| | | | | |
|---|---|---|---|---|
| 5,497,008 | A | 3/1996 | Kumakhov | |
| 6,307,917 | B1 * | 10/2001 | Shimizu et al. | 378/145 |
| 6,359,964 | B1 * | 3/2002 | Kogan | 378/87 |
| 6,807,251 | B2 * | 10/2004 | Okanda et al. | 378/71 |
| 6,917,667 | B2 * | 7/2005 | Fujinawa et al. | 378/70 |
| 6,990,177 | B2 * | 1/2006 | Fujinawa et al. | 378/149 |
| 7,035,373 | B2 * | 4/2006 | Omote | 378/79 |
| 2003/0123610 | A1 * | 7/2003 | Okanda et al. | 378/71 |
| 2004/0066896 | A1 * | 4/2004 | Fujinawa et al. | 378/92 |
| 2007/0009091 | A1 * | 1/2007 | Terada | 378/70 |

FOREIGN PATENT DOCUMENTS

| | | | |
|---|---|---|---|
| JP | 62-299241 | A | 12/1987 |
| JP | 7-40080 | B2 | 5/1995 |
| JP | 11-287773 | A | 10/1999 |
| JP | 2004-205305 | A | 7/2004 |

OTHER PUBLICATIONS

Extended European Search Report dated Feb. 8, 2008 issued in counterpart European Application.

* cited by examiner

*Primary Examiner*—Edward J Glick
*Assistant Examiner*—Thomas R Artman
(74) *Attorney, Agent, or Firm*—Frishauf, Holtz, Goodman & Chick, P.C.

(57) ABSTRACT

An X-ray optical system provides selectively a linear X-ray beam and a point X-ray beam while using an X-ray source which generates an X-ray beam having a linear section. When the point X-ray beam is selected, an X-ray intensity per unit area becomes higher. The X-ray optical system has an X-ray source, a parabolic multilayer mirror to which an aperture slit plate is attached, an optical-path selection slit device, a poly-capillary optics and an exit-width restriction slit. The poly-capillary optics and the exit-width restriction slit are detachably inserted into a path of a parallel beam coming from the parabolic multilayer mirror, and thus they can be removed from the path and a Soller slit and a divergence slit can be inserted instead.

7 Claims, 15 Drawing Sheets

X-RAY OPTICAL SYSTEM

BACKGROUND OF THE INVENTION

The present invention relates to an X-ray optical system for converting an X-ray beam having a linear section into a converging beam focused on a point with the use of a polycapillary optics.

In the field of an X-ray diffraction apparatus, there is known a particular technique, which easily changes over between an optical system for the parallel beam method and another optical system for the Bragg-Brentano focusing method, the technique being disclosed in U.S. Pat. No. 6,807,251 B2, which will be referred to as the first publication hereinafter.

FIG. 13 is a perspective view illustrating an incident optical system of an X-ray diffraction apparatus disclosed in the first publication, in which an optics for the parallel beam method has been selected. An X-ray source 10 generates an X-ray beam 12 having a linear section. The X-ray beam 12 passes through the second aperture 16 of an aperture slit plate 14, and thereafter is reflected by a parabolic multilayer mirror 18 to become a parallel beam 20. The parallel beam 20 passes through an aperture 24 of an optical-path selection slit device 22, and thereafter passes through a Soller slit 26 and a divergence slit 28, and the parallel beam 20 is to travel toward a sample. What is incident on the sample is the parallel beam 20.

FIG. 14 is a perspective view illustrating another state of the incident optical system of the X-ray diffraction apparatus disclosed in the first publication, in which an optics for the Bragg-Brentano focusing method has been selected. As compared with the state shown in FIG. 13, the optical-path selection slit device 22 has been rotated by 180 degrees around its center, so that the position of the aperture 24 has been shifted to the right side. The X-ray beam 12 having the linear section passes through the first aperture 15 of the aperture slit plate 14, noting that the X-ray beam 12 is a diverging beam. The diverging beam passes through the aperture 24 of the optical-path selection slit device 22, and thereafter passes through the Soller slit 26 and the divergence slit 28, and the beam 12 is to travel toward the sample. What is incident on the sample is the diverging beam 12, which is usable as an incident beam in the X-ray diffraction apparatus using the Bragg-Brentano focusing method. The diverging beam has a divergence angle, which is regulated by a slit width of the divergence slit 28.

When using the incident optical system shown in FIGS. 13 and 14 in the X-ray diffraction apparatus, changeover is easily made between the parallel beam method and the Bragg-Brentano focusing method only by rotation of the optical-path selection slit device 22. In this case, the height H (vertical size in FIGS. 13 and 14) of the X-ray irradiation region on the sample is almost the same as the length L of the linear X-ray source 10.

Incidentally, the present invention is concerned with the conversion of the parallel beam into the converging beam with the use of the polycapillary optics. Such a conversion technique is disclosed in Japanese Patent Publication No. 7-40080 B (1995) (the second publication).

The second publication discloses that one end of the polycapillary optics is adapted to receive a parallel beam and the other end is adapted to discharge a converging beam, so that the converging X-ray beam is incident on a small region of a sample. The use of the polycapillary optics provides the converging beam with a higher X-ray intensity per unit area.

Besides, the present invention is also concerned with a combination of the polycapillary optics and the parabolic multilayer mirror. In connection therewith, a combination of a flat monochromator and the polycapillary optics is suggested in Japanese Patent Publication No. 2004-205305 A (the third publication).

The third publication discloses a total-reflection fluorescent X-ray analysis apparatus, in which an X-ray source generates an X-ray beam, which is then made monochromatic by a flat monochromator, and thereafter enters into one capillary tube of a total-reflection type. The capillary tube has an exit, which is narrowed in inner diameter so as to discharge a converging beam. The third publication also describes that a bundle of plural capillary tubes are usable instead of one capillary tube.

In the parallel beam method shown in FIG. 13, when it is planned to carry out X-ray diffraction measurement for a small region of a sample, it is necessary to reduce the sectional size of an X-ray beam arriving at the sample so that the X-ray beam is incident on the small region only. The first method therefor is to use a point X-ray source instead of the linear X-ray source. The second method is, as shown in FIG. 15, to arrange a selection slit device 32 for small region, which is formed with a small aperture 30, behind a multilayer mirror 18, and to add a height-restriction slit 34 at a divergence slit 28, i.e., the second method uses a two-slit optics for the small region. When the first method is adopted, it is necessary to prepare the point X-ray source other than the linear X-ray source, or to prepare a special X-ray tube whose focus can be changed over between the line focus and the point focus. When the second method is adopted, the major part of the parallel beam 20 is interrupted by the selection slit device 32 and the height-restriction slit 34, so that the intensity of the X-ray beam 21 arriving at the sample is remarkably reduced.

Incidentally, when the prior art disclosed in the second publication is used, it is sure that a converging beam focused on a point is obtained from the parallel beam, but the obtained beam is not monochromatic. In addition, the parallel beam that should be received is considered to be a parallel beam with a circular section, that is to say, the second publication does not mention the conversion of the X-ray beam having the linear section into a converging beam focused on a point. Further, the second publication does not mention changeover from an optics providing a converging beam focused on a point into another optics.

When the prior art disclosed in the third publication is used, there is obtained a monochromatic beam because the flat monochromator is used, and the obtained beam converges on a point. However, the parallel beam that should be received is considered to be a parallel beam with a circular section, that is to say, the third publication does not mention the conversion of the X-ray beam having the linear section into a converging beam focused on a point. Further, the third publication does not mention changeover from an optics providing a converging beam focused on a point into another optics.

SUMMARY OF THE INVENTION

It is an object of the present invention to provide an X-ray optical system, in which a linear X-ray beam and a point X-ray beam is selectively obtained while using an X-ray source which generates an X-ray beam having a linear section, and an X-ray intensity per unit area becomes higher when the point X-ray beam is selected.

An X-ray optical system according to the present invention comprises: an X-ray source, which generates an X-ray beam having a linear section; a diverging-beam path, in which the X-ray beam diverges with a predetermined divergence angle in a plane including both a direction perpendicular to a longitudinal direction of a cross section of the X-ray beam and a traveling direction of the X-ray beam, the plane being referred to as a specific plane hereinafter; a parallel-beam path, in which the X-ray beam travels in parallel in the specific plane; a parabolic multilayer mirror, which is arranged between the X-ray source and the parallel-beam path, and has a reflective surface having a parabolic shape in the specific plane and a parabolic focal point located on the X-ray source, and reflects the X-ray beam coming from the X-ray source at the reflective surface to generate a parallel beam; an optical-path selection slit device, which allows any one of the diverging and parallel beams to pass through and interrupts other of the diverging and parallel beams; and a polycapillary optics, which is detachably inserted into the parallel-beam path at a position behind the optical-path selection slit device, and receives the parallel beam and discharges a converging beam focused on a point.

The polycapillary optics may have one end for receiving the parallel beam, the one end being elongate in cross section so as to receive the parallel beam having a linear section. Namely, the polycapillary optics may have a flat outer shape.

The polycapillary optics may be arranged so as to be exchangeable for a Soller slit, which restricts a vertical divergence of the X-ray beam having the linear section. When the polycapillary optics is inserted into an X-ray path, a converging beam focused on a point is obtained. On the other hand, when the Soller slit restricting the vertical divergence is inserted, a parallel beam having a linear section or a diverging beam is obtained.

The X-ray optical system according to the present invention has an advantage that a linear X-ray beam and a point X-ray beam is selectively obtained while using an X-ray source, which generates an X-ray beam having a linear section, and an X-ray intensity per unit area becomes higher when the point X-ray beam is selected.

DETAILED DESCRIPTION OF THE PREFERRED EMBODIMENTS

Figure 1:
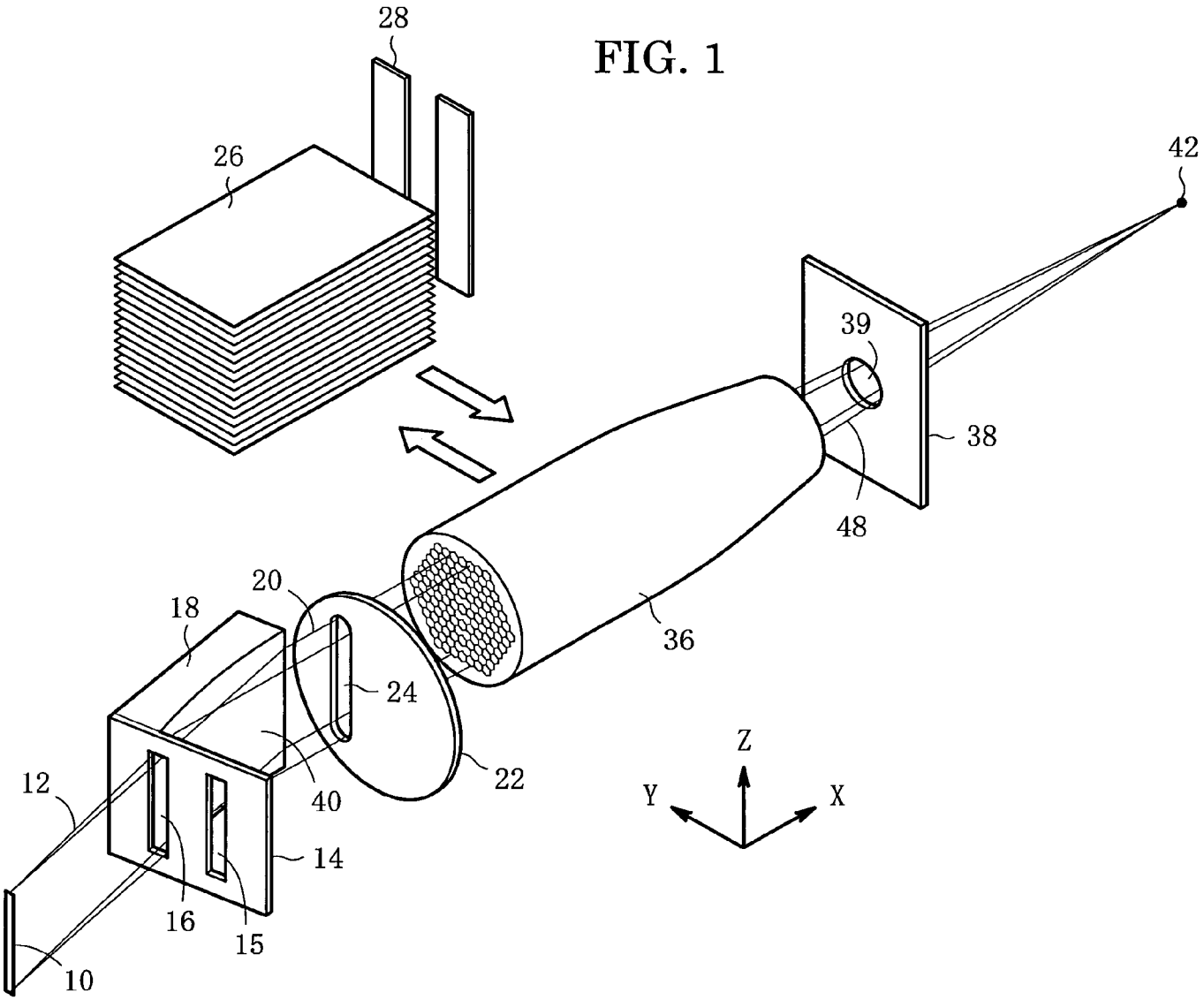
FIG. 1 is a perspective view of the first embodiment of the X-ray optical system according to the present invention.

Embodiments of the present invention will now be described in detail below with reference to the drawings. FIG. 1 is a perspective view of the first embodiment of the X-ray optical system according to the present invention. The X-ray optical system can be in three possible states: the first state providing a parallel beam having a linear section; the second state providing a diverging beam having a linear section; and the third state providing a converging beam focused on a point. Any one of the states may be selected by an operator. FIG. 1 shows the third state. The X-ray optical system includes an X-ray source 10, a parabolic multilayer mirror 18 to which an aperture slit plate 14 is attached, an optical-path selection slit device 22, a polycapillary optics 36, and a exit-width restriction slit 38. The X-ray optical system further includes a Soller slit 26 and a divergence slit 28 as replacement parts. A combination of the polycapillary optics 36 and the exit-width restriction slit 38 can be replaced with a combination of the Soller slit 26 and the divergence slit 28. Namely, the polycapillary optics 36 and the exit-width restriction slit 38 are detachably inserted into a path of parallel beam 20 that comes from the parabolic multilayer mirror 18, and they can be removed from the path. In the vacant space after the removal, the Soller slit 26 and the divergence slit 28 can be inserted.

In FIG. 1, X-axis, Y-axis, and Z-axis, which intersect with one another at right angles, are set with directions shown in the figure. Stating in detail, a direction extending from the X-ray source 10 toward the focus point 42 of the converging beam, i.e., a traveling direction of the X-ray beam, is the X-axis, a direction extending along the linear X-ray source 10 is the Z-axis, and a direction perpendicular to both the X-axis and the Z-axis is the Y-axis. The Y-axis corresponds to a direction perpendicular to the longitudinal direction (Z-axis) of the cross section of the X-ray beam. In the present invention, the phrase "parallel beam" means X-rays collimated in the X-Y plane (a plane including both the direction perpendicular the longitudinal direction of the cross section of the X-ray beam and the traveling direction of the X-ray beam), and the phrase "diverging beam" means X-rays diverging in the X-Y plane. Accordingly, the parallel beam is collimated or diverges in the Z-X plane. Similarly, the diverging beam is collimated or diverges in the Z-X plane. It should be noted that the X-Y plane corresponds to the specific plane in the present invention.

The X-ray source 10 generates an X-ray beam 12 having a linear section. The X-ray source 10 may be, for example, the line focus of a rotating-anode X-ray tube. The X-ray beam 12 has a cross section with a size of 8 mm times 0.04 mm for instance at the position soon after the rotating-anode X-ray tube. The X-ray beam 12 gradually diverges as it travels.

The aperture slit plate 14 is fixed to an end face of the multilayer mirror 18 with screws to unite with the multilayer mirror. The aperture slit plate 14 is formed with the first aperture 15 for the diverging beam and the second aperture 16 for the parallel beam. Assuming the aperture slit plate for CuK$\alpha$ rays, the first aperture 15 is 1.1 mm in width and about 13 mm in length, and the second aperture 16 is 0.7 mm in width and about 13 mm in length.

The multilayer mirror 18 has a reflective surface 40, which has a parabolic shape in the X-Y plane, and the multilayer mirror 18 is arranged so that the X-ray source 10 is on the parabolic focal point. The X-ray beam is reflected by the reflective surface 40 to become the parallel beam 20. The reflective surface 40 consists of a synthetic multilayer having heavy element layers and light element layers laminated alternately, the laminate pitch varying continuously along the parabolic surface. With this structure, X-rays having the specific wavelength (CuKα rays in this embodiment) satisfy the Bragg's diffraction condition at all points on the reflective surface 40. Such a parabolic multilayer mirror is disclosed, for example, in Japanese Patent Publication No. 11-287773 A (1999) (the fourth publication).

The multilayer mirror 18 also functions as a monochromator because the mirror reflects only X-rays having the specific wavelength to generate the parallel beam, i.e., the mirror makes X-rays monochromatic.

The optical-path selection slit device 22 has a substantially disc shape, and is formed with one elongate aperture 24. The aperture 24 is 3 mm in width and about 12 mm in length. The optical-path selection slit device 22 can be rotated by 180 degrees around its center. The aperture 24 is positioned in an eccentric position with respect to the center of the optical-path selection slit device 22. In the state shown in FIG. 1, the aperture 24 is located on the left side of the center to allow only the parallel beam 20 coming from the multilayer mirror 18 to pass through. The thus-arranged optical-path selection slit device 22 may be rotated by 180 degrees to shift the aperture 24 to the right side of the center, the resultant arrangement allowing the diverging beam to pass through as will be described below.

Figure 2A:
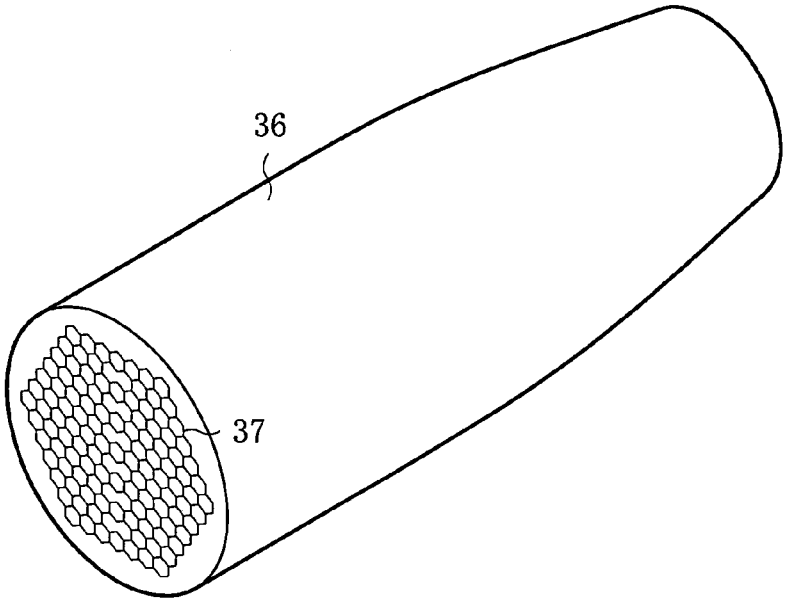
FIGS. 2A and 2B are a perspective view and a sectional plan view of the polycapillary optics respectively.

FIG. 2A is a perspective view of the polycapillary optics 36. A polycapillary optics for X-rays typically consists of a bundle of many capillary tubes (for example extra fine glass tubes), and each capillary tube is adapted to reflect X-rays with total reflection at its inner surface. The polycapillary optics 36 used in the embodiment is of a monolithic type, and has a honeycomb structure 37 in a cross section perpendicular to an axial direction. It should be noted, however, that the polycapillary optics of the type consisting of a bundle of cylindrical glass tubes may be used for the present invention.

Figure 2B:
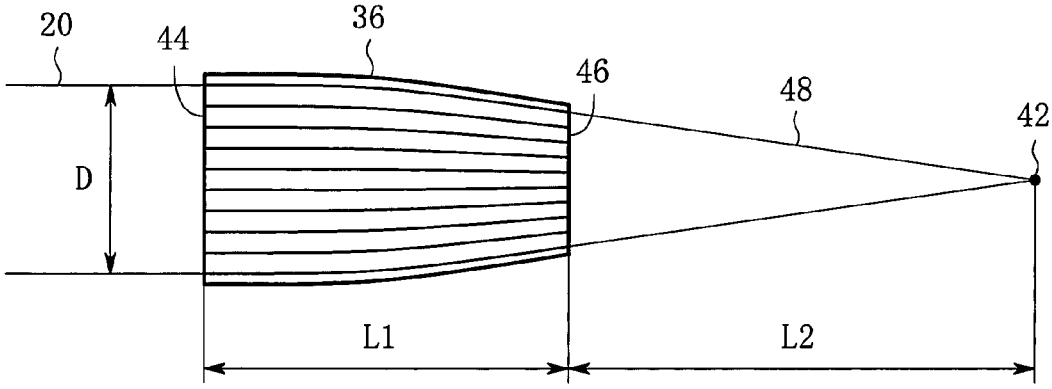

FIG. 2B is a sectional plan view of the polycapillary optics 36 shown in FIG. 2A. The polycapillary optics 36 has one end 44, at which respective capillary channels are arranged substantially in parallel, so that the end 44 can receive the parallel beam 20, which will be reflected by the inner surfaces of the capillary channels with total reflection. The polycapillary optics 36 has the other end 46, at which respective capillary channels extend in directions converging on a focus point 42. The converging beam 48 discharged from the other end 46 converges on the focus point 42, i.e., the converging beam is focused on a point. Each capillary channel has an inner diameter, which is gradually narrowed and slightly curved. The inner surface of the capillary channel has a small curvature so that the X-ray beam is incident on the inner surface with a glancing angle smaller than the critical angle θc of total reflection regarding the specific X-ray wavelength (CuKα in the embodiment). The critical angle θc of total reflection depends on the wavelength used and the inner surface material of the capillary. In the case of using CuKα for example, when the inner surface material of the capillary is Si or $SiO_2$, the critical angle θc of total reflection is about 0.2 degree. When the material is Cu or Fe, the critical angle is about 0.4 degree. When the material is Au or Pt, the critical angle is about 0.6 degree. The polycapillary optics 36 is about 40 mm in total length L1, and 98 mm in distance L2 between the other end 46 and the focus point 42, and about 10 mm in incident aperture D of the one end 44.

Turning to FIG. 1, the exit-width restriction slit 38 is formed with a circular aperture 39. The exit-width restriction slit 38 restricts the sectional size of the converging beam 48 discharged from the polycapillary optics 36. The exit-width restriction slit 38 also interrupts scatter X-rays coming from any place other than the polycapillary optics 36.

Figure 3:
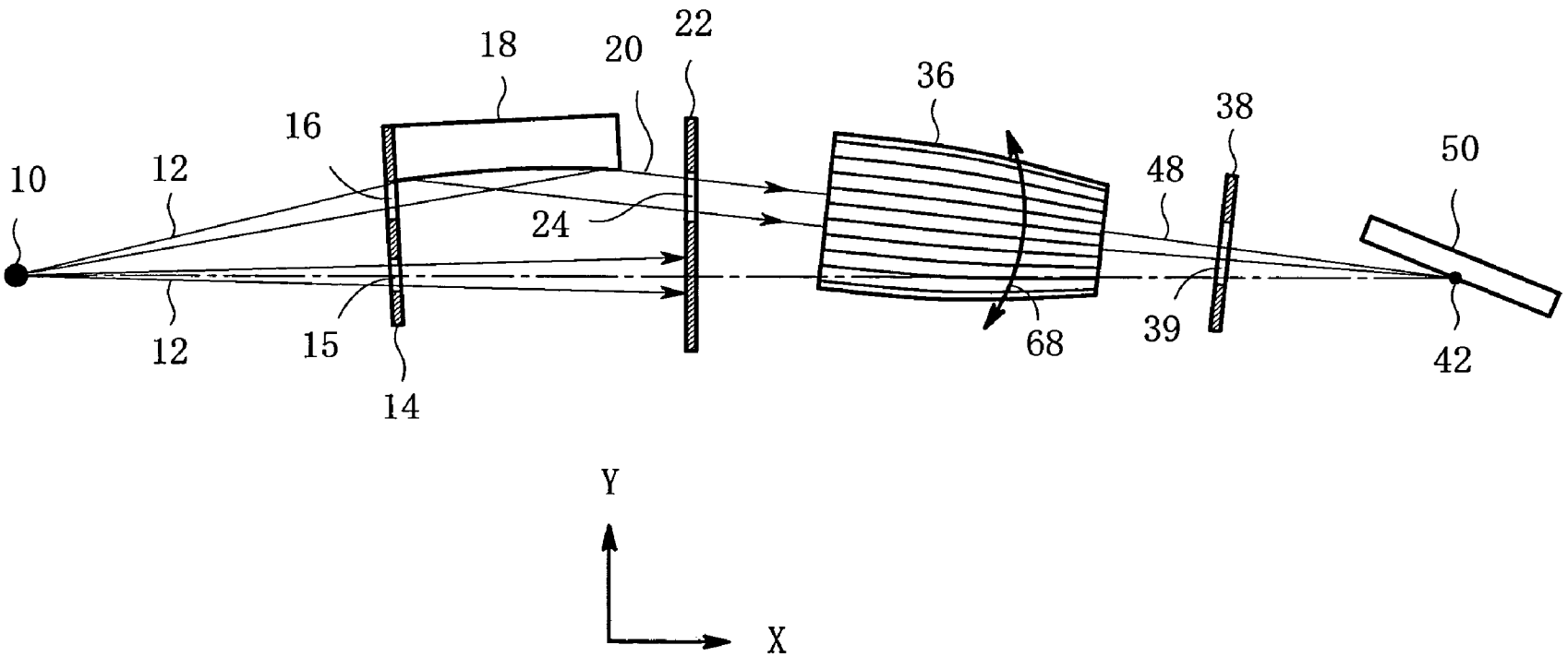
FIG. 3 is a plan view of the X-ray optical system shown in FIG. 1.
Figure 4:
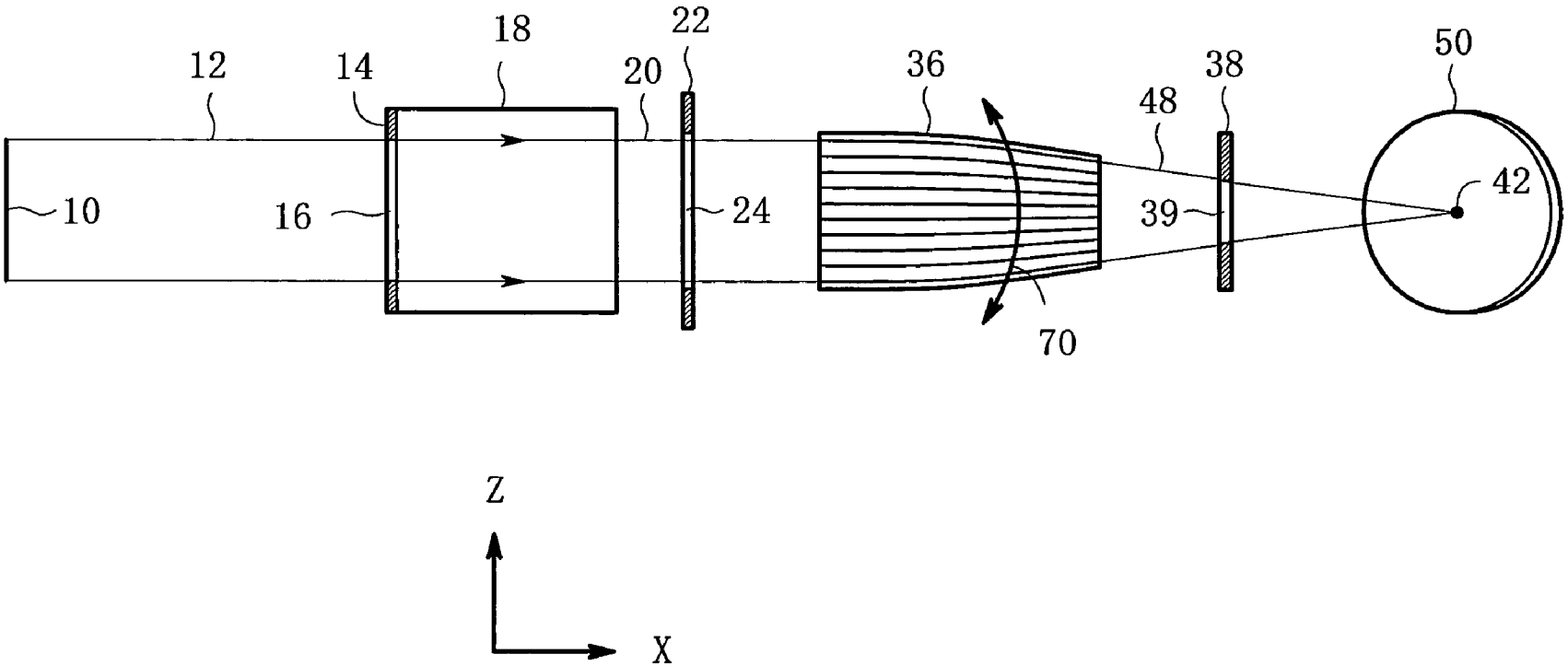
FIG. 4 is a side view along an X-ray path that provides a converging beam in the X-ray optical system shown in FIG. 1.

FIG. 3 is a plan view of the X-ray optical system shown in FIG. 1, and FIG. 4 is a side view along an X-ray path that provides converging beam in the X-ray optical system shown in FIG. 1. In FIGS. 3 and 4, the X-ray source 10 emits the X-ray beam 12, a part of which passes through the first aperture 15 of the aperture slit plate 14, but is interrupted by the optical-path selection slit device 22. Another part of the X-ray beam 12 passes through the second aperture 16 of the aperture slit plate 14, and is reflected by the multilayer mirror 18 to become the parallel beam 20, which further passes through the aperture 24 of the optical-path selection slit device 22. Thereafter, the parallel beam 20 enters into the polycapillary optics 36 to be converted into the converging beam 48 focused on a point. The converging beam 48 is restricted in sectional size by the aperture 39 of the exit-width restriction slit 38, and converges on a small region of the sample 50. It should be noted that the sample 50 is assumed to be a sample for X-ray diffraction measurement in FIGS. 3 and 4. If the small region, which should be measured, on the sample 50 is moved to the focus point 42 of the polycapillary optics 36, it is possible to measure the small region with the X-ray diffraction measurement.

Figure 15:
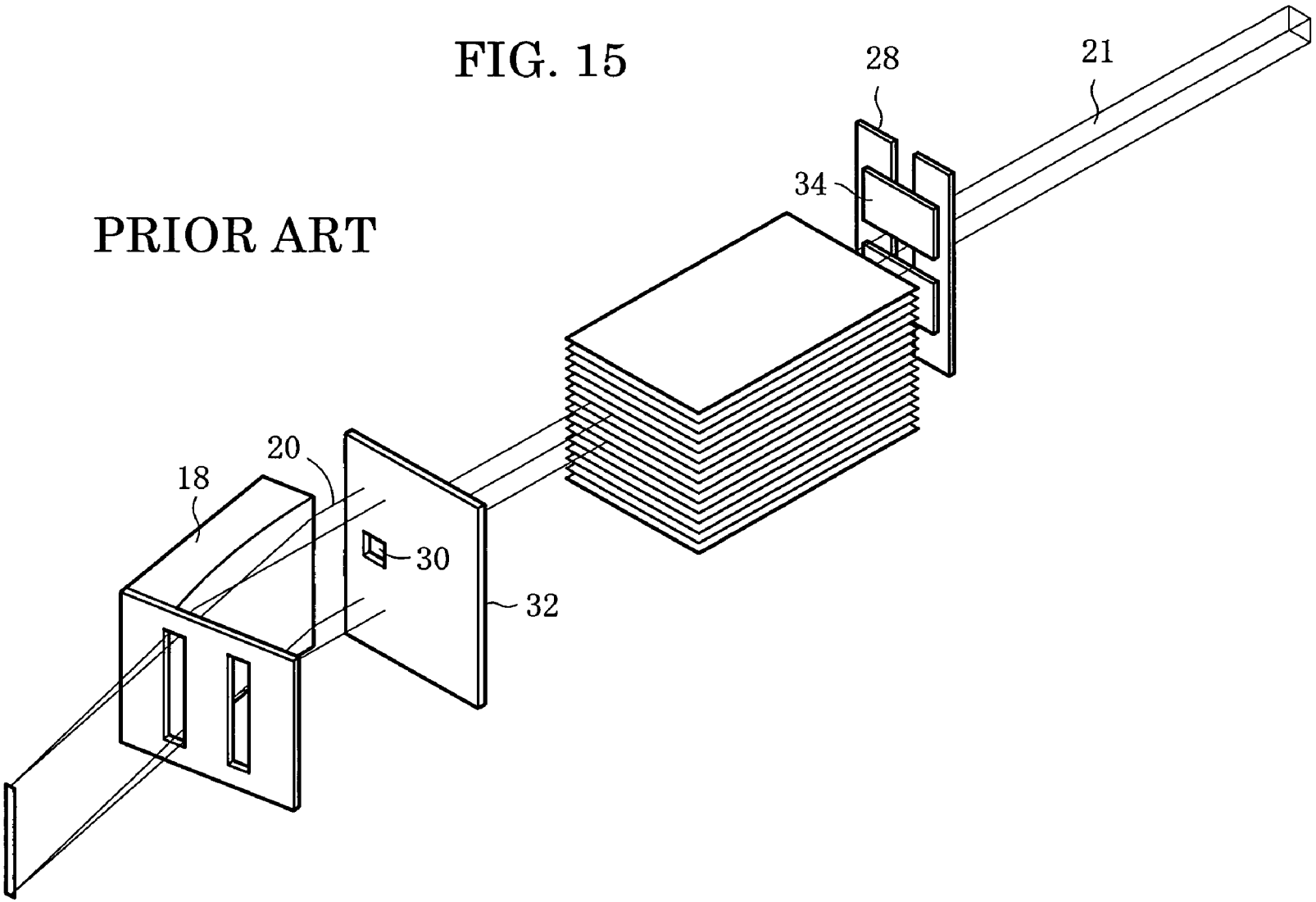
FIG. 15 PRIOR ART
FIG. 15 is a perspective view illustrating the prior art method for providing an X-ray beam for small region measurement.

In the X-ray optical system, the size of an X-ray irradiation region is about 0.4 mm along the Z-axis direction, and about 0.4 mm along the Y-axis direction too. These values have been measured at the full width at half maximum intensity of the X-ray intensity distribution. As described above, even using the linear X-ray source, the converging beam focused on a point is obtained with the use of a combination of the multilayer mirror and the polycapillary optics. In addition, the X-ray intensity per unit area at the focus point 42 increases remarkably as compared with the case using the two-slit optics as shown in FIG. 15.

The polycapillary optics is easily adjusted in angle. Namely, in FIG. 3, the polycapillary optics 36 may be rotated (denoted by an arrow 68) for adjustment in the X-Y plane so that the angular alignment is attained between the parallel beam 20 and the polycapillary optics 36. This operation is enough for the angular adjustment. In FIG. 4, the angular adjustment (denoted by an arrow 70) in the Z-X plane is not required, because the parallel beam 20 diverges as it travels in the Z-X plane, and thus it makes no sense to conduct accurate angular alignment between the parallel beam 20 and the polycapillary optics in the Z-X plane.

Figure 5:
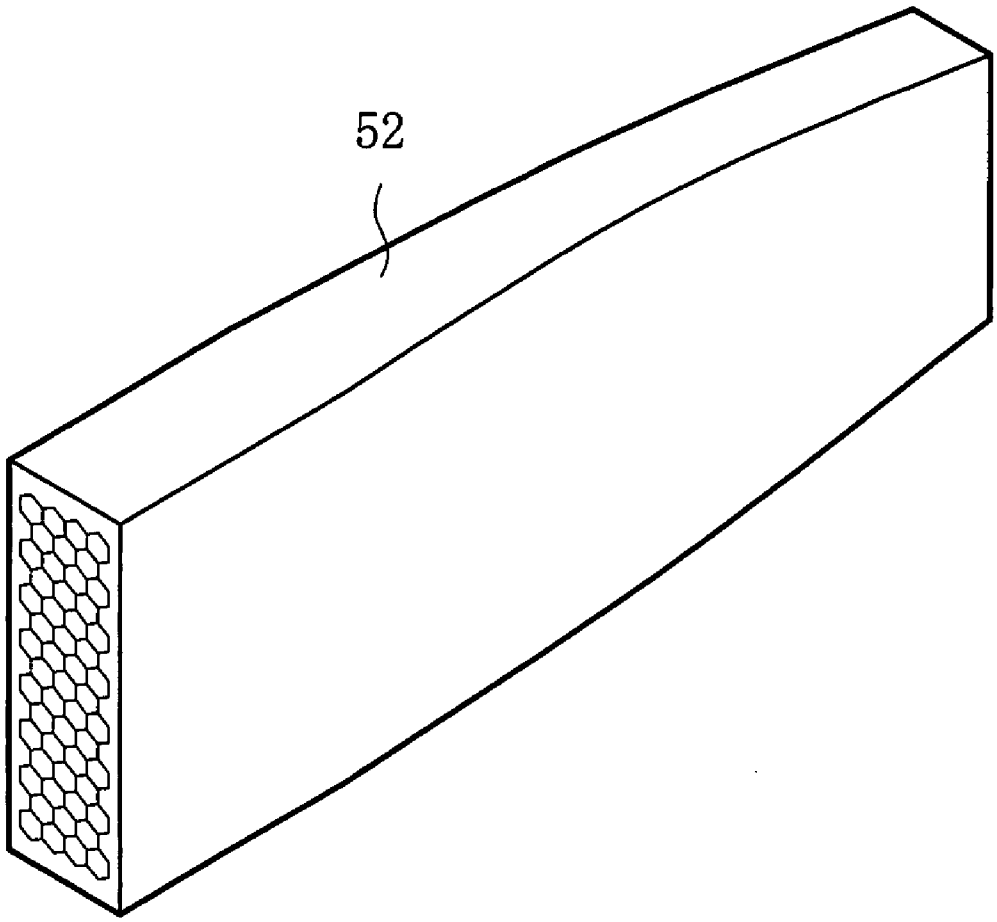
FIG. 5 is a perspective view of a modified polycapillary optics.

FIG. 5 is a perspective view of a modified polycapillary optics. A polycapillary optics 52 has a flat outer shape, and is specially made for receiving the X-ray beam having the linear section. Namely, the polycapillary optics 52 has one end for receiving the parallel beam, the one end being elongate so as to be suitable for receiving the X-ray beam having the linear section. The polycapillary optics 52 may be used instead of the polycapillary optics 36 used in FIG. 1, the polycapillary optics 36 having a circular section perpendicular to the axial direction.

Figure 6:
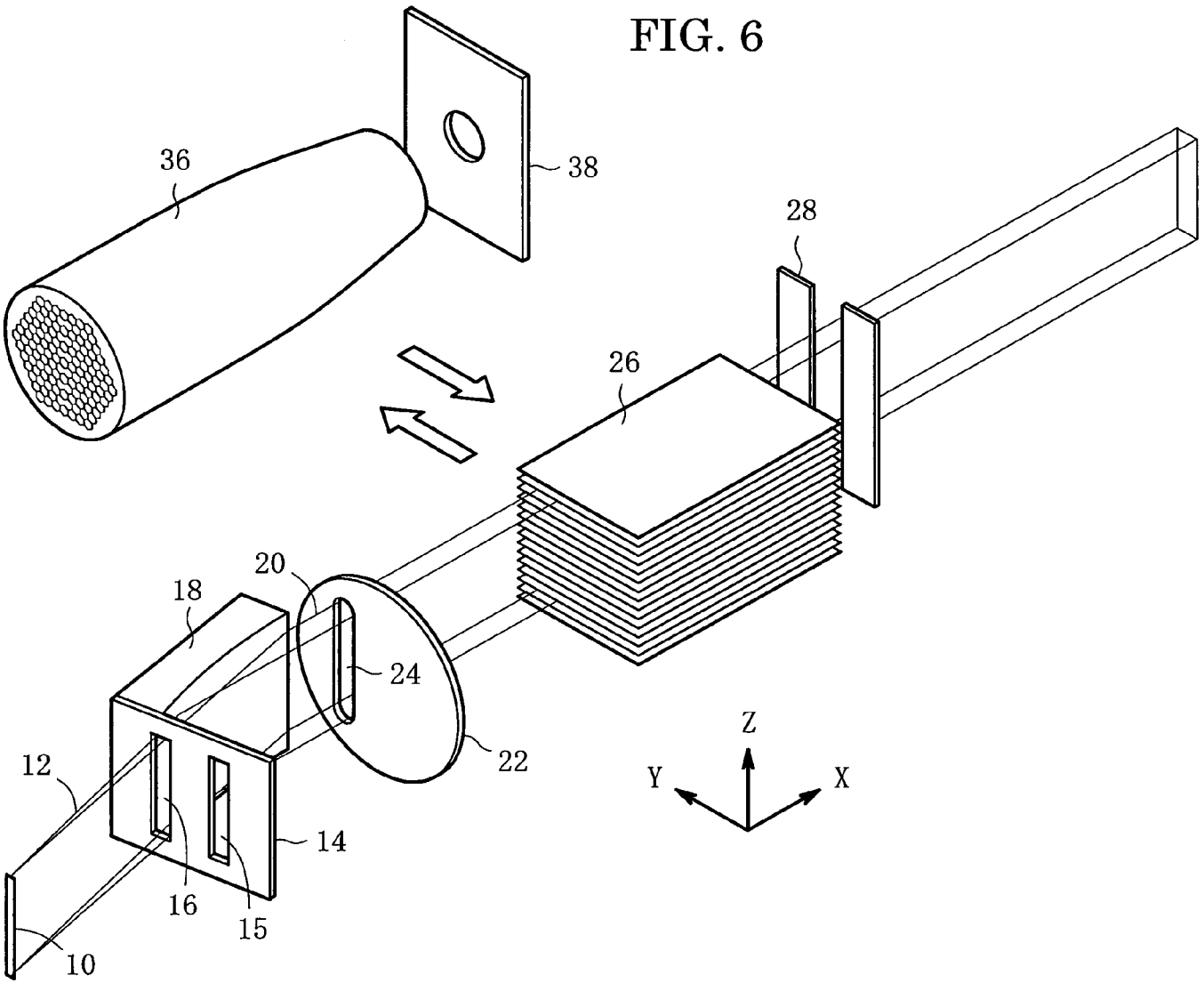
FIG. 6 is a perspective view of the X-ray optical system shown in FIG. 1 in the first state.
Figure 7:
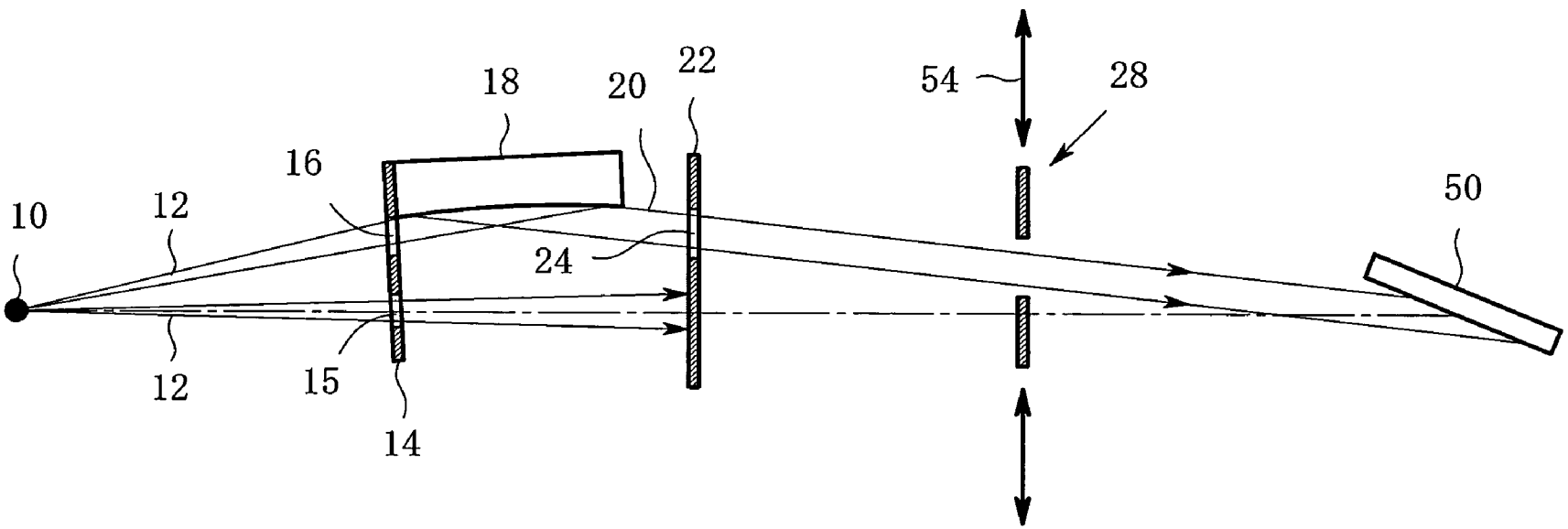
FIG. 7 is a plan view of the state shown in FIG. 6.

FIG. 6 is a perspective view of the X-ray optical system shown in FIG. 1 in the first state, which provides the parallel beam having the linear section. The state shown in FIG. 6 is obtained in a manner described below. Staring from the state shown in FIG. 1, the polycapillary optics 36 and the exit-width restriction slit 38 are removed from the X-ray path, and instead thereof the Soller slit 26 and the divergence slit 28 are inserted into the X-ray path. FIG. 7 is a plan view of the state shown in FIG. 6, noting that the Soller slit is omitted. In FIGS. 6 and 7, the X-ray source 10 emits the X-ray beam 12, a part of which passes through the first aperture 15 of the aperture slit plate 14, but is interrupted by the optical-path selection slit device 22. Another part of the X-ray beam 12 passes through the second aperture 16 of the aperture slit plate 14, and is reflected by the multilayer mirror 18 to become the parallel beam 20, which further passes through the aperture 24 of the optical-path selection slit device 22. Thereafter, the parallel beam 20 is restricted in vertical divergence (divergence in the Z-X plane) by the Soller slit 26, and then passes through the divergence slit 28 to be incident on the sample 50 (see FIG. 7). The divergence slit 28 has an aperture width, which is regulated by an electric motor, that is, each of slit blades is movable in a direction (denoted by an arrow 54 in FIG. 7) almost perpendicular to the X-ray traveling direction. If it is desired to use the whole parallel beam 20, the divergence slit 28 is allowed to have the maximum aperture width so as not to interrupt the parallel beam 20. If it is desired to restrict the beam width to the predetermined value, the slit width of the divergence slit 28 is regulated to be a desired beam width. It should be noted that the sample 50 is assumed to be a sample for X-ray diffraction measurement in FIG. 7. In this first state, the parallel beam 20 is incident on the sample 50, and thus the X-ray diffraction measurement using the parallel beam method is possible.

In FIG. 6, a channel cut crystal may be inserted instead of the Soller slit 26.

Figure 8:
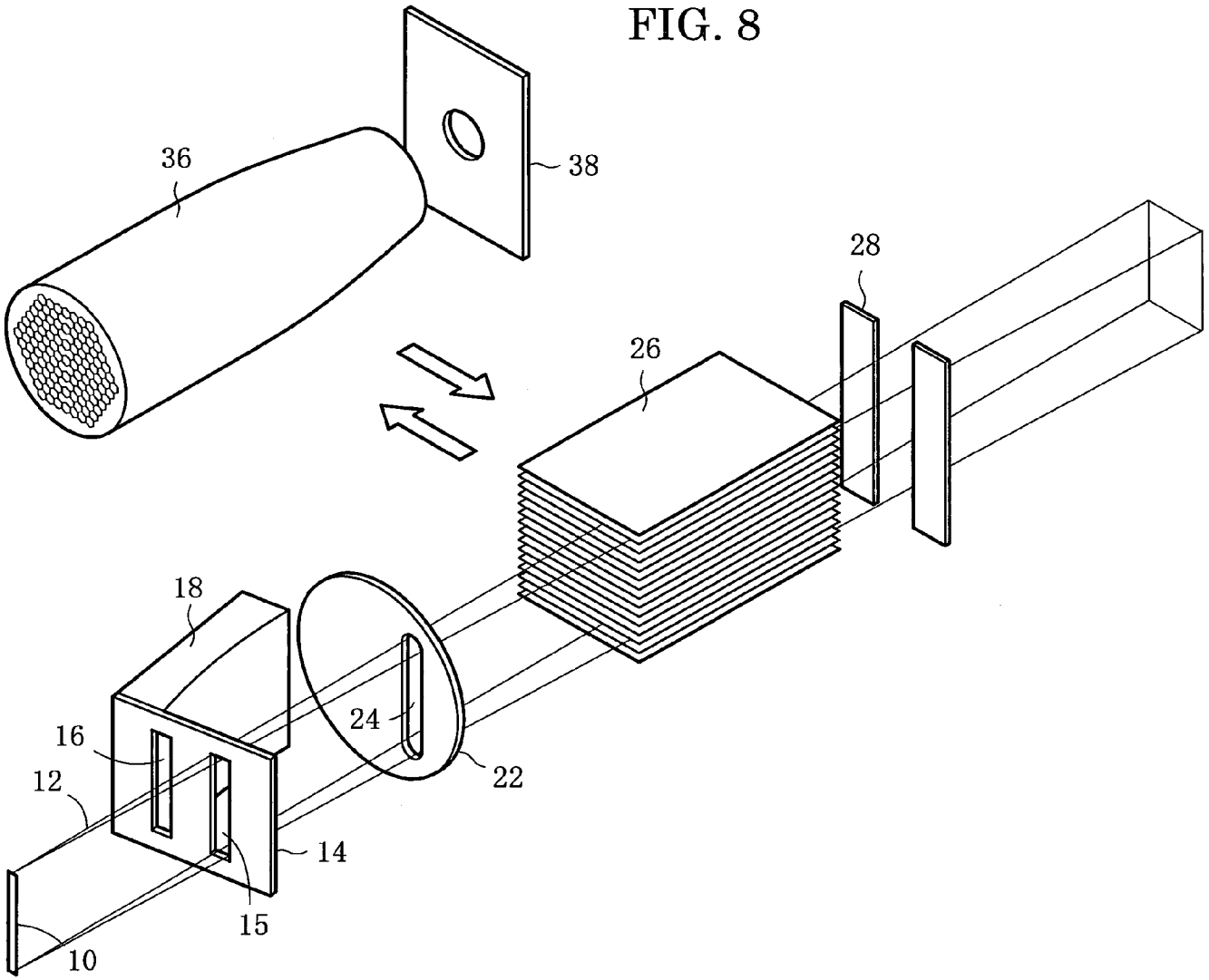
FIG. 8 is a perspective view of the X-ray optical system shown in FIG. 1 in the second state.
Figure 9:
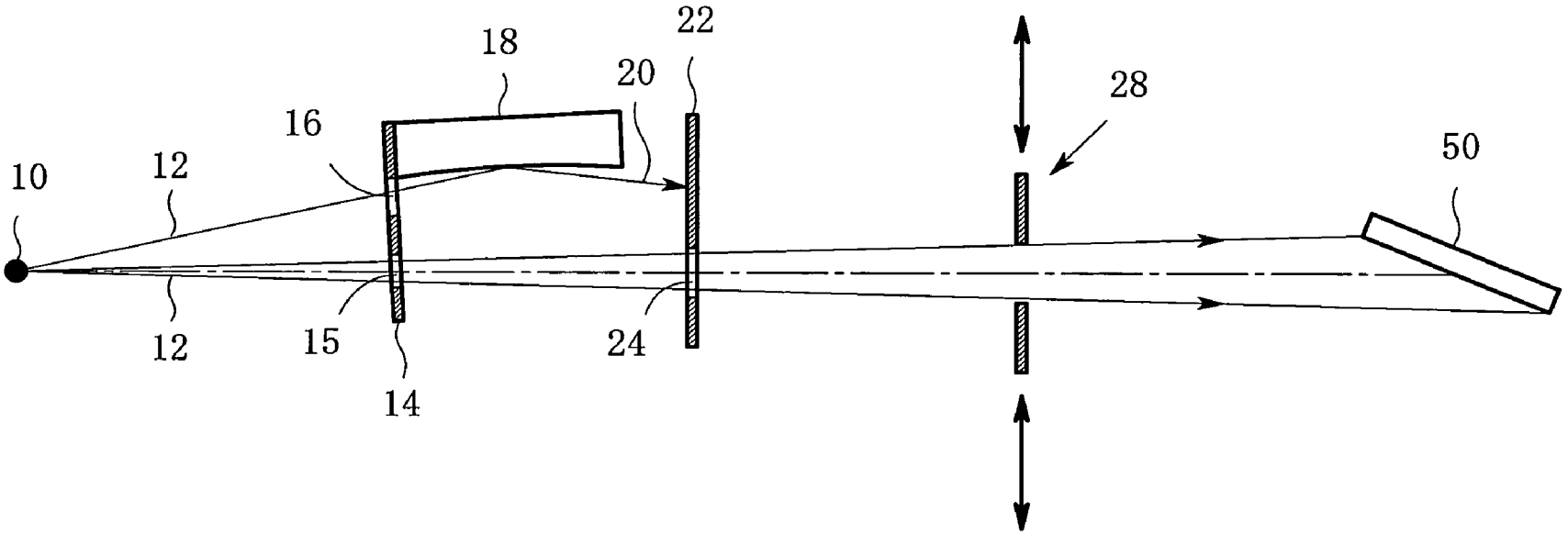
FIG. 9 is a plan view of the state shown in FIG. 8.

FIG. 8 is a perspective view of the X-ray optical system shown in FIG. 1 in the second state, which provides the diverging beam having a linear section. The state shown in FIG. 8 is obtained in a manner described below. Staring from the state shown in FIG. 6, the optical-path selection slit device 22 is rotated by 180 degrees around its center. FIG. 9 is a plan view of the state shown in FIG. 8, noting that the Soller slit is omitted. In FIGS. 8 and 9, the X-ray source 10 emits the X-ray beam 12, a part of which passes through the second aperture 16 of the aperture slit plate 14, and is reflected by the multilayer mirror 18 to become the parallel beam 20, which is interrupted by the optical-path selection slit device 22. Another part of the X-ray beam 12 passes through the first aperture 15 of the aperture slit plate 14, and passes through the aperture 24 of the optical-path selection slit device 22. Thereafter, the X-ray beam 12 is restricted in vertical divergence (divergence in the Z-X plane) by the Soller slit 26, and is further restricted in divergence angle by the divergence slit 28 to be incident on the sample 50 (see FIG. 9). It should be noted that the sample 50 is assumed to be a sample for X-ray diffraction measurement in FIG. 9. In this second state, the diverging beam 12 is incident on the sample 50, and thus the X-ray diffraction measurement using the Bragg-Brentano focusing method is possible.

It should be noted that the center point of the X-ray irradiation region on the sample is on the same location among the third state shown in FIG. 3, the first state shown in FIG. 7 and the second state shown in FIG. 9. Namely, the multilayer mirror 18 is located so that such a condition is satisfied.

Figure 10:
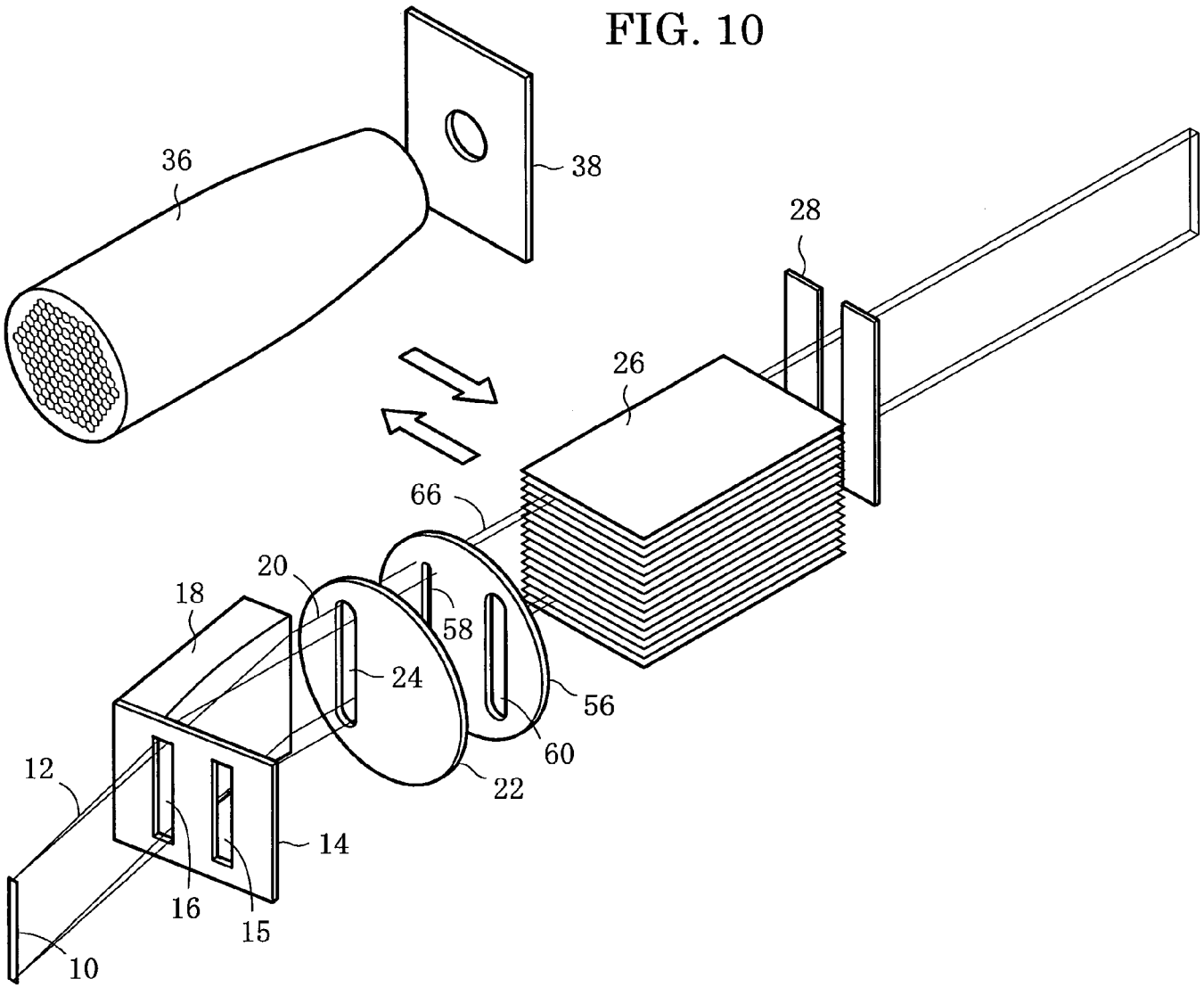
FIG. 10 is a perspective view of the second embodiment.
Figure 11:
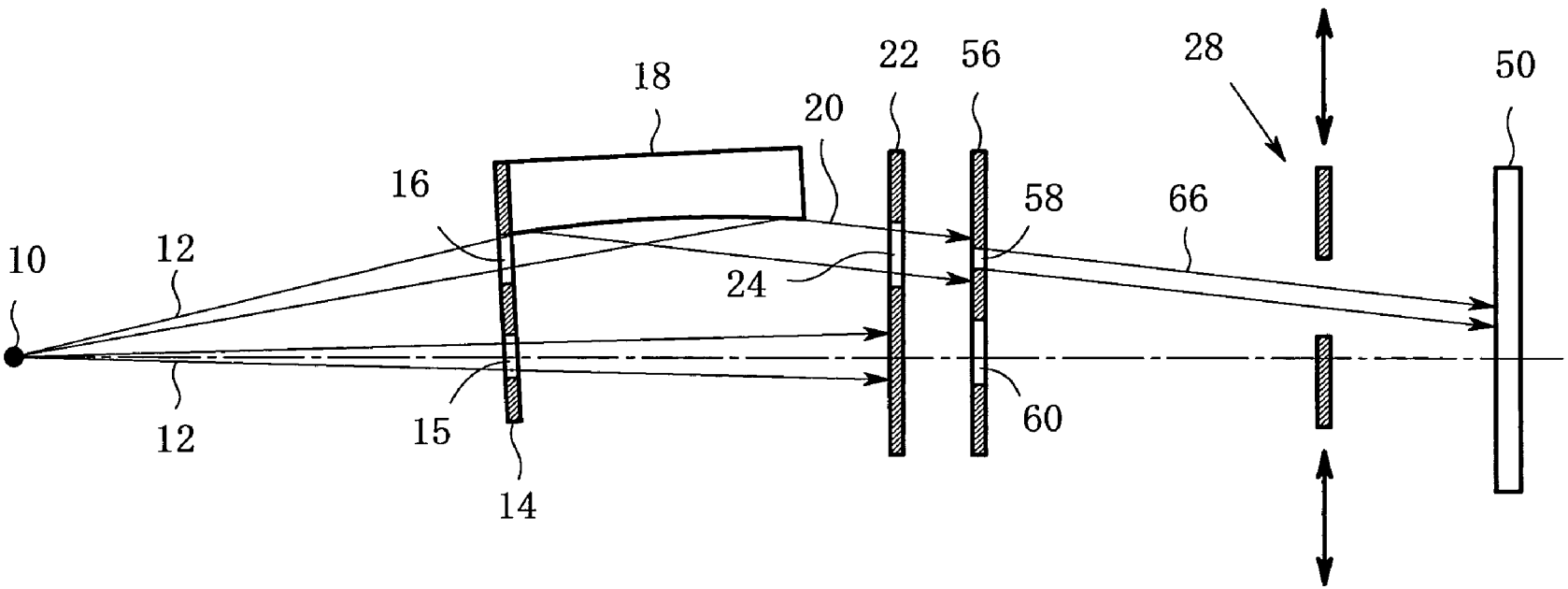
FIG. 11 is a plan view of the X-ray optical system shown in FIG. 10.

Next, the second embodiment of the present invention will be described. The second embodiment makes the optical system of the first embodiment exchangeable also into an optical system for small-angle scattering measurement. FIG. 10 is a perspective view of the second embodiment. The X-ray optical system shown in FIG. 10 corresponds to the X-ray optical system of the first embodiment, to which a small-angle selection slit device 56 is added. FIG. 11 is a plan view of the X-ray optical system shown in FIG. 10. In FIGS. 10 and 11, a small-angle selection slit device 56 is arranged behind the optical-path selection slit device 22. The small-angle selection slit device 56 has a substantially disc shape, and is formed with a narrow slit 58 and a pass-through aperture 60 arranged at 180-degree rotation symmetric positions with respect to the disc center. The narrow slit 58 is for restricting (i.e., narrowing) the width of the parallel beam 20 that has been reflected by the multilayer mirror 18. The narrow slit 58 is 0.03 mm in width and about 12 mm in height. On the other hand, the pass-through aperture 60 is for merely allowing the X-ray beam to pass through. The aperture 60 is 3 mm in width and about 12 mm in height.

In FIGS. 10 and 11, the X-ray source 10 emits the X-ray beam 12, a part of which passes through the first aperture 15 of the aperture slit plate 14, and is interrupted by the optical-path selection slit device 22. Another part of the X-ray beam 12 passes through the second aperture 16 of the aperture slit plate 14, and is reflected by the multilayer mirror 18 to become the parallel beam 20, which passes through the aperture 24 of the optical-path selection slit device 22. Thereafter, the parallel beam 20 is restricted in beam width by the narrow slit 58 of the small-angle selection slit device 56 to become a parallel beam 66 having a narrow width. The parallel beam 66 is restricted in vertical divergence (divergence in the Z-X plane) by the Soller slit 26, and passes through the divergence slit 28 (which functions as a slit for interrupting scatter X-rays) to be incident on the sample 50 (see FIG. 11). It should be noted that, in FIG. 11, the sample 50 is assumed to be a sample for small angle scattering measurement. This optical system uses a combination of the beam collimation by the multilayer mirror 18 and the beam narrowing by the narrow slit 58 to provide the beam 66 for the small angle scattering measurement. In FIG. 10, the optical system for the small angle scattering measurement may be changed to an optical system for providing a converging beam focused on a point in a manner described below. The small-angle selection slit device 56, the Soller slit 26, and the divergence slit 28 are removed from the X-ray path, and thereafter the polycapillary optics 36 and the exit-width restriction slit 38 are inserted instead.

This second embodiment makes it possible to change the state shown in FIG. 10 to an optical system providing the parallel beam having an ordinary width or an optical system providing the diverging beam. The changeover is accomplished by altering the rotational position of the optical-path selection slit device 22 and the small-angle selection slit device 56 as will be described below.

Figure 12A:
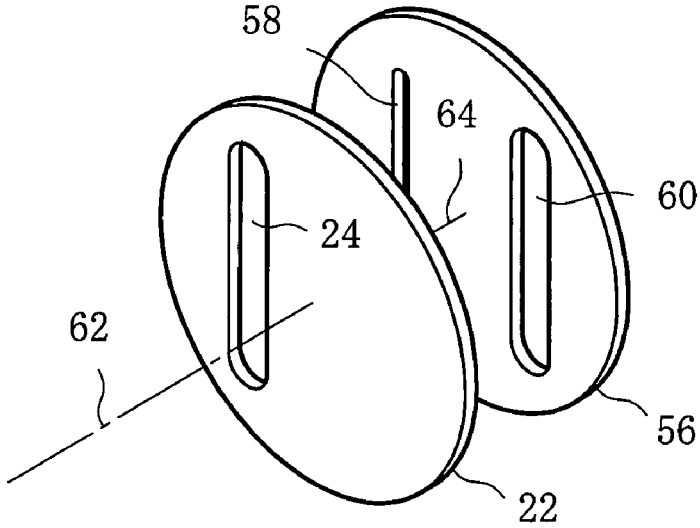
FIGS. 12A to 12C are perspective views illustrating three kinds of states in combination of an optical-path selection slit device and a small-angle selection slit device.

FIG. 12A shows the state realizing an optical system for the small angle scattering measurement. The aperture 24 of the optical-path selection slit device 22 is positioned on the left side of the axis of rotation 62. On the other hand, regarding the small-angle selection slit device 56, the narrow slit 58 is positioned on the left side of the axis of rotation 64, whereas the pass-through aperture 60 is positioned on the right side of the axis of rotation 64. Namely, the state shown in FIG. 12A is the same as the state shown in FIG. 10.

Figure 12B:
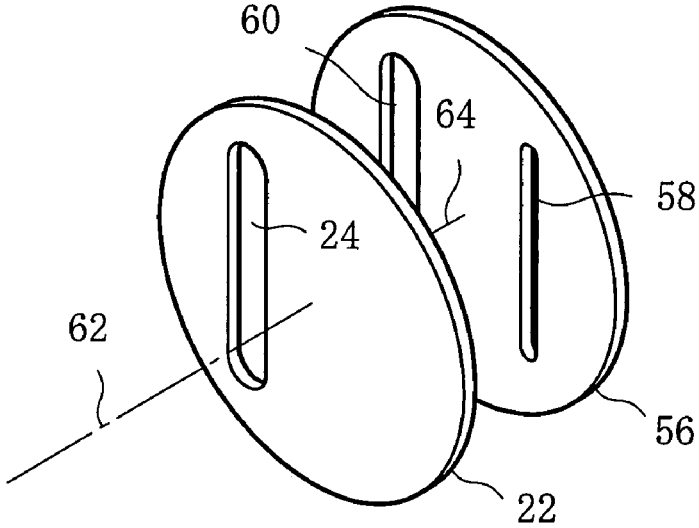

FIG. 12B shows the state realizing an optical system for providing the parallel beam having the ordinary width. Regarding the optical-path selection slit device 22, as with the case shown in FIG. 12A, the aperture 24 is positioned on the left side of the axis of rotation 62. On the other hand, the small-angle selection slit device 56 is rotated by 180 degrees from the state shown in FIG. 12A, so that the narrow slit 58 is positioned on the right side of the axis of rotation 64, whereas the pass-through aperture 60 is positioned on the left side of the axis of rotation 64. With this state, the parallel beam coming from the multilayer mirror passes through both the aperture 24 of the optical-path selection slit device 22 and the pass-through aperture 60 of the small-angle selection slit device 56.

Figure 12C:
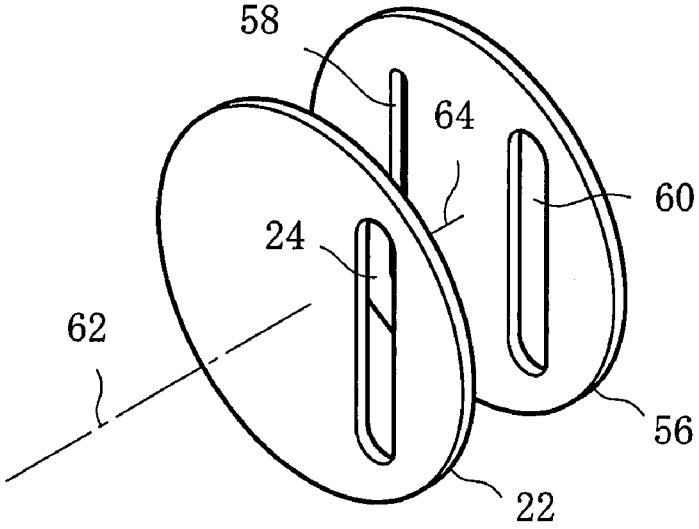
Figure 13:
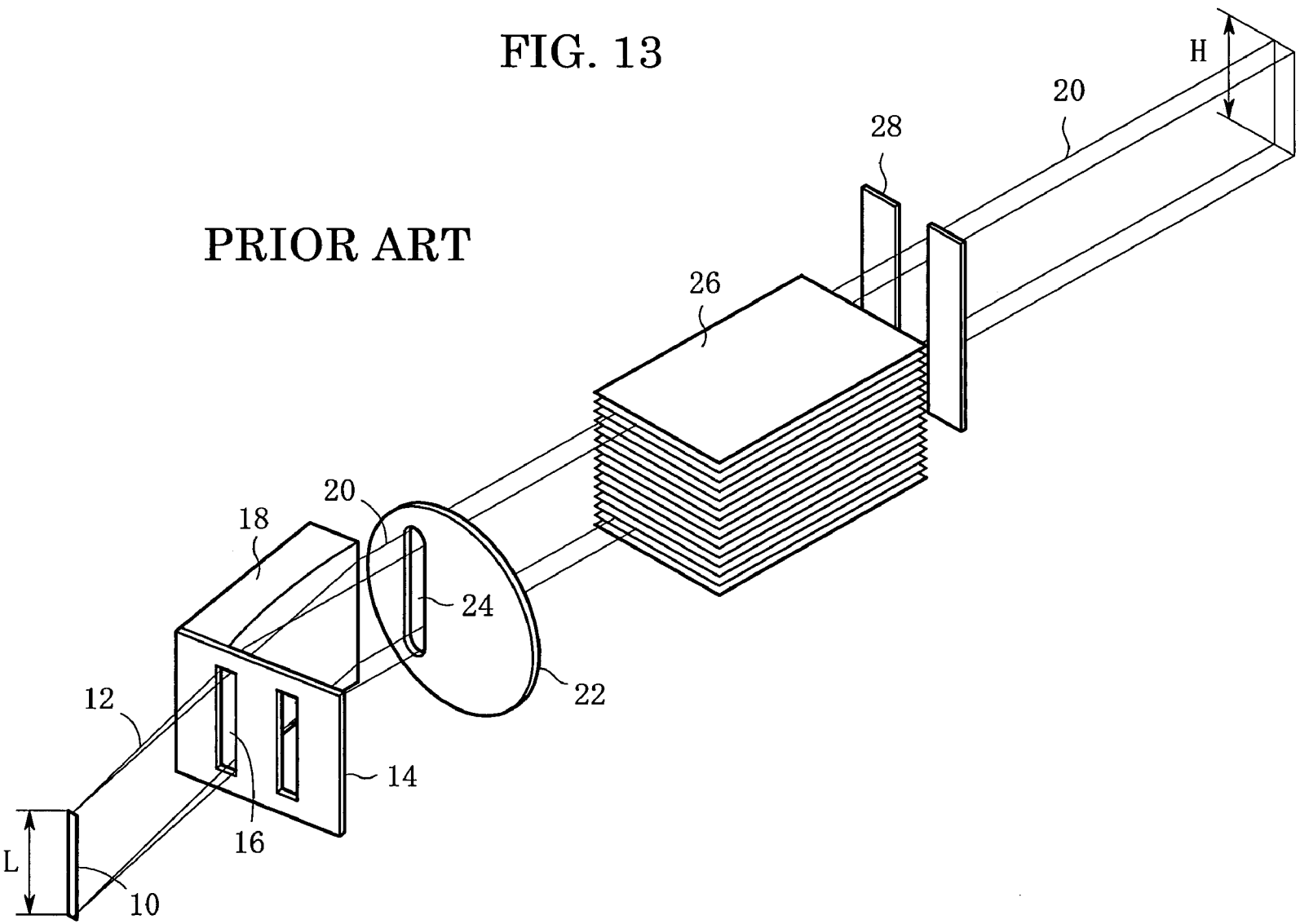
FIG. 13 PRIOR ART
FIG. 13 is a perspective view illustrating an incident optical system of an X-ray diffraction apparatus disclosed in the first publication, in which an optics providing the parallel beam method has been selected.
Figure 14:
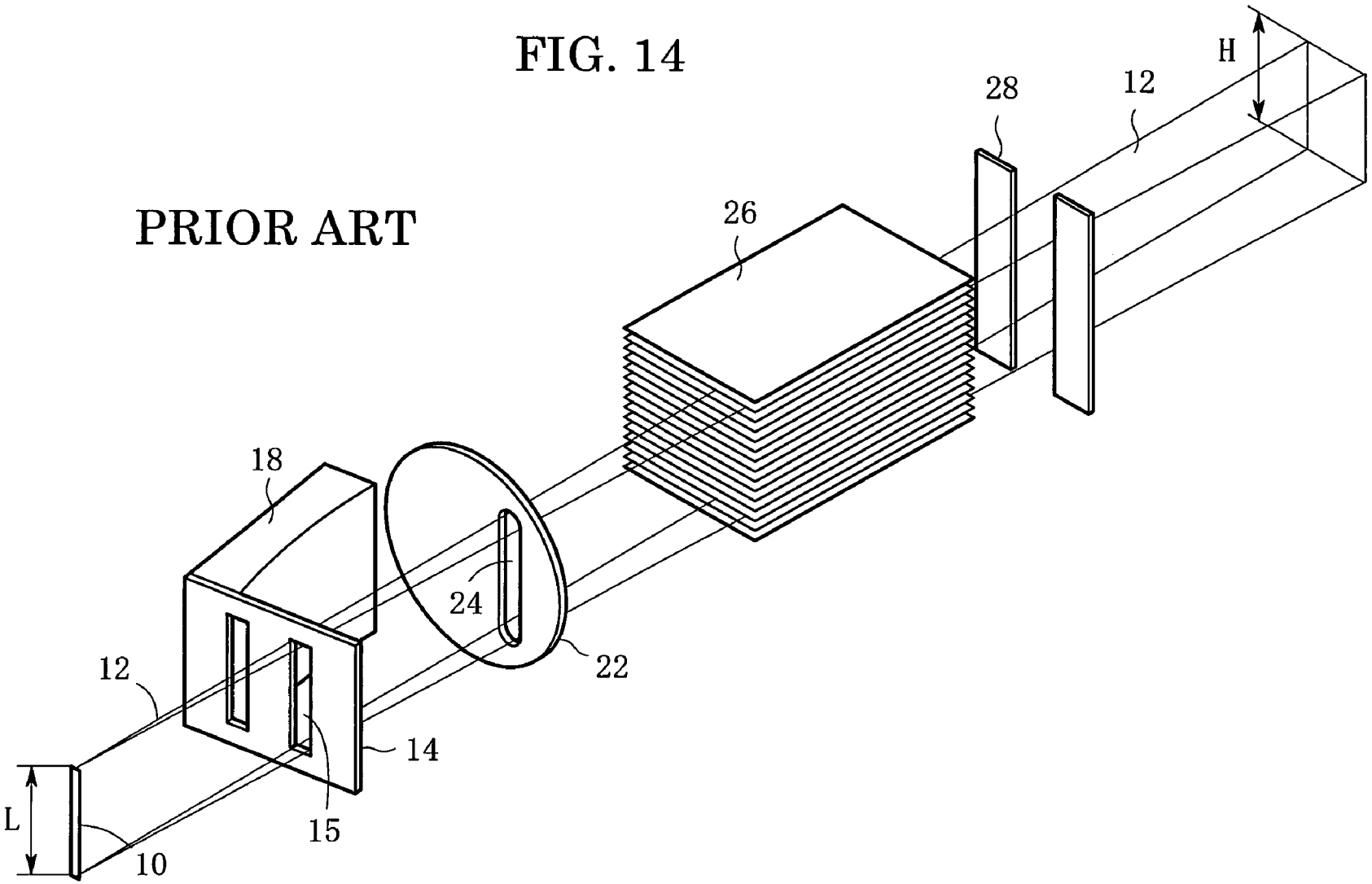
FIG. 14 PRIOR ART
FIG. 14 is a perspective view illustrating an incident optical system of an X-ray diffraction apparatus disclosed in the first publication, in which an optics providing the Bragg-Brentano focusing method has been selected.

FIG. 12C shows the state realizing an optical system for providing the diverging beam. The optical-path selection slit device 22 is rotated by 180 degrees from the state shown in FIG. 12A, so that the aperture 24 is positioned on the right side of the axis of rotation 62. Regarding the small-angle selection slit device 56, as with the case shown in FIG. 12A, the narrow slit 58 is positioned on the left side of the axis of rotation 64, whereas the pass-through aperture 60 is positioned on the right side of the axis of rotation 64. With this state, the parallel beam coming from the multilayer mirror is interrupted by the optical-path selection slit device 22. The diverging beam coming from the X-ray source passes through both the aperture 24 of the optical-path selection slit device 22 and the pass-through aperture 60 of the small-angle selection slit device 56.

By the way, an X-ray optical system making it possible to change over among an optical system for the small angle scattering measurement, an optical system for providing the parallel beam, and an optical system for providing the diverging beam is disclosed in U.S. Pat. No. 6,990,177 B2 (the fifth publication).

It can be said that the second embodiment shown in FIG. 10 corresponds to the X-ray optical system disclosed in the fifth publication, to which there is added as one of options an optics for providing the converging beam focused on a point with the use of the polycapillary optics.

What is claimed is:

1. An X-ray optical system comprising:

an X-ray source, which generates an X-ray beam having a linear section;

a diverging-beam path, in which the X-ray beam diverges with a predetermined divergence angle in a plane including both a direction perpendicular to a longitudinal direction of a cross section of the X-ray beam and a traveling direction of the X-ray beam, the plane being referred to as a specific plane hereinafter;

a parallel-beam path, in which the X-ray beam travels in parallel in the specific plane;

a parabolic multilayer mirror, which is arranged between the X-ray source and the parallel-beam path, and has a reflective surface having a parabolic shape in the specific plane and a parabolic focal point located on the X-ray source, and reflects the X-ray beam coming from the X-ray source at the reflective surface to generate a parallel beam;

an optical-path selection slit device, which allows any one of the diverging and parallel beams to pass through and interrupts other of the diverging and parallel beams; and a polycapillary optics, which is detachably inserted into the parallel-beam path at a position behind the optical-path selection slit device, and receives the parallel beam and discharges a converging beam focused on a point.

2. The X-ray optical system according to claim 1, wherein the polycapillary optics has one end for receiving the parallel beam, the one end being elongate in cross section so as to receive the parallel beam having a linear section.

3. The X-ray optical system according to claim 1, wherein the polycapillary optics is arranged so as to be exchangeable for a Soller slit, which restricts a vertical divergence of the X-ray beam having the linear section.

4. The X-ray optical system according to claim 1, further comprising an exit-width restriction slit arranged on an X-ray discharge side of the polycapillary optics.

5. The X-ray optical system according to claim 4, wherein the exit-width restriction slit is formed with a circular aperture.

6. The X-ray optical system according to claim 1, wherein the polycapillary optics is of a monolithic type, which has a honeycomb structure in a cross section perpendicular to an axial direction of the polycapillary optics.

7. The X-ray optical system according to claim 1, wherein the polycapillary optics is adjustable by rotation for an angular alignment between the parallel beam and the polycapillary optics.

* * * * *